US010456903B2

(12) United States Patent
Peng

(10) Patent No.: US 10,456,903 B2
(45) Date of Patent: Oct. 29, 2019

(54) MULTI-POINT CUSTOM POSITION GRIP MODIFICATION SYSTEM

(71) Applicant: Robin Peng, Sandy, UT (US)

(72) Inventor: Robin Peng, Sandy, UT (US)

( * ) Notice: Subject to any disclaimer, the term of this patent is extended or adjusted under 35 U.S.C. 154(b) by 0 days.

(21) Appl. No.: 16/049,458

(22) Filed: Jul. 30, 2018

(65) Prior Publication Data

US 2018/0333837 A1 Nov. 22, 2018

Related U.S. Application Data

(63) Continuation-in-part of application No. 15/709,016, filed on Sep. 19, 2017, now abandoned.

(60) Provisional application No. 62/396,572, filed on Sep. 19, 2016.

(51) Int. Cl.

| | |
|---|---|
| ***B25G 1/10*** | (2006.01) |
| ***A63B 60/12*** | (2015.01) |
| ***A63B 60/08*** | (2015.01) |
| ***A63B 60/14*** | (2015.01) |

(52) U.S. Cl.

CPC ..... *B25G 1/102* (2013.01); *A63B 60/08* (2015.10); *A63B 60/12* (2015.10); *A63B 60/14* (2015.10); *A63B 2209/10* (2013.01); *Y10T 16/476* (2015.01)

(58) Field of Classification Search

CPC ..... B25G 1/102; A63B 60/08; A63B 60/12; A63B 60/14; A63B 2209/10; Y10T 16/466; Y10T 16/476

USPC ..... 16/421, 430; 473/206, 549; D21/753, D21/756

See application file for complete search history.

(56) References Cited

U.S. PATENT DOCUMENTS

| | | | | | |
|---|---|---|---|---|---|
| 3,036,836 | A * | 5/1962 | Mason | A63B 53/14 | 473/206 |
| 3,860,243 | A * | 1/1975 | Prisco, Sr. | A63B 69/3685 | 473/206 |
| 4,599,920 | A * | 7/1986 | Schmid | B25G 1/102 | 16/11 |
| 4,785,495 | A * | 11/1988 | Dellis | B25G 1/102 | 16/421 |
| 5,155,878 | A * | 10/1992 | Dellis | B29C 43/021 | 16/421 |
| 5,482,270 | A * | 1/1996 | Smith | A63B 60/12 | 473/568 |
| 5,492,324 | A * | 2/1996 | Hagey | A63B 49/08 | 473/551 |
| 5,775,756 | A * | 7/1998 | Rozenich | A63B 21/0724 | 16/421 |
| 5,867,868 | A * | 2/1999 | Ward | A63B 49/08 | 16/422 |

(Continued)

*Primary Examiner* — William L Miller
(74) *Attorney, Agent, or Firm* — Dobbin IP Law P.C.; Geoffrey E. Dobbin

(57) ABSTRACT

Tool grips and handles may be enhanced by the addition of modular inserts which compensate for two voids in the human hand. A first insert may fill a void in the palm of the hand while a second may fill one by the fingers. By filling the voids, a more natural, relaxed, and customizable grip may be achieved for almost any handle. Use of a plurality of inserts allows for customization according to hand size while the size of the inserts also accounts for the size, dimensions, and axes of the handle and tool in general. Meniscus-shaped inserts may be stacked on one another for optimum effect.

6 Claims, 5 Drawing Sheets

(56) References Cited

U.S. PATENT DOCUMENTS

| | | | | |
|---|---|---|---|---|
| 6,017,283 | A * | 1/2000 | Hagey | A63B 49/08 473/551 |
| 6,105,460 | A * | 8/2000 | Li | B62K 21/26 74/551.9 |
| 6,237,193 | B1 * | 5/2001 | Skerker | A47J 45/06 16/430 |
| 6,916,260 | B1 * | 7/2005 | Poteet | A63B 49/08 473/551 |
| 7,351,167 | B1 * | 4/2008 | Hathaway | A63B 69/0002 473/457 |
| 8,881,347 | B2 * | 11/2014 | Feinstein | B25G 1/01 16/430 |
| D767,059 | S * | 9/2016 | Murphy, Jr. | D21/753 |
| D767,060 | S * | 9/2016 | Murphy, Jr. | D21/753 |
| 10,046,215 | B2 * | 8/2018 | Eastman | A63B 59/58 |
| 2004/0154133 | A1 * | 8/2004 | Polzin | B25F 5/006 16/430 |
| 2011/0005790 | A1 * | 1/2011 | Frank | B25F 5/006 173/162.2 |

* cited by examiner

MULTI-POINT CUSTOM POSITION GRIP MODIFICATION SYSTEM

CROSS-REFERENCES TO RELATED APPLICATIONS

The present application claims priority as a continuation-in-part application based on prior filed U.S. application Ser. No. 15/709,016, now abandoned, which was in turn a non-provisional perfection of prior filed U.S. Application No. 62/396,572, filed Sep. 19, 2016. Both applications are incorporated by reference in their entirety.

FIELD OF THE INVENTION

The present invention relates to the field of hand grips and more particularly relates to a system to modify existing grips to better comport with the anatomy of a hand.

BACKGROUND OF THE INVENTION

It stands to reason that when using a hand tool, there must be a portion of the tool, a grip, for the user to grasp with the user's hand. Designs for grips vary according to the type of tool, preferences of the user, additional functionality, etc. In more modern times, ergonomics, the science of how the human body interacts with and uses its surroundings, including tools, has become of utmost importance. Proper ergonomic design has been shown to reduce injuries from repetitive motion. This science includes any interaction of human and tool, and would include a hand with a grip.

Many tools and sporting equipment, such as rackets and paddles for various sports, are notoriously non-ergonomic. Usually these grips, or handles, are no more than a stick extending from the wired frame. The handle is generally made of planar sides with no accommodation for the natural gaps formed in a user's hands. As a result, players of these sports tend to over compensate by gripping the handle around the index finger and thumb with too much force (FIGS. 2 and 3), leading to repetitive strain injuries such as tennis or golfer's elbow. The handle construction described is not limited to rackets, as similar construction is found on baseball bats and golf clubs (which tend to be conical), and many other tools.

The present invention is a modular grip enhancement system which endeavors to properly support a user's hand anatomy and prevent the excessive gripping pressure caused by planar or conical handles or grips. The modular grip enhancement system is applicable to any type of handle or grip and is customizable for the hand geometry of the user and the geometry of the grip.

The present invention represents a departure from the prior art in that the modular grip enhancement system of the present invention allows for more dynamic ergonomic interaction between user and grip areas along multiple axes, while being modifiable to accommodate the various and size of hand and handle grip style by the user.

SUMMARY OF THE INVENTION

In view of the foregoing disadvantages inherent in the known types of tool grips, this invention provides a modular grip enhancement system. As such, the present invention's general purpose is to provide a new and improved grip enhancement system that utilizes multiple interchangeable parts so as to adapt a given handle to a user's hand. To accomplish these objectives, the grip enhancement system comprises at least one forward and at least one rearward component. All components may be temporarily mounted upon a grip so that a user may use the grip with the enhancement modules in place before permanently affixing the enhancement modules. The modules are designed to support two gaps in the grasping hand: one by the juncture of the two middle fingers with the palm and one cavity in the center of the palm itself. Different shapes and sizes accommodate multiple users and multiple existing handles.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the present invention. It is important, therefore, that the claims be regarded as including such equivalent constructions insofar as they do not depart from the spirit and scope of the present invention.

DETAILED DESCRIPTION OF THE PREFERRED EMBODIMENT

With reference now to the drawings, a preferred embodiment of modular grip enhancements is herein described. It should be noted that the articles "a", "an", and "the", as used in this specification, include plural referents unless the content clearly dictates otherwise.

Figure 1:
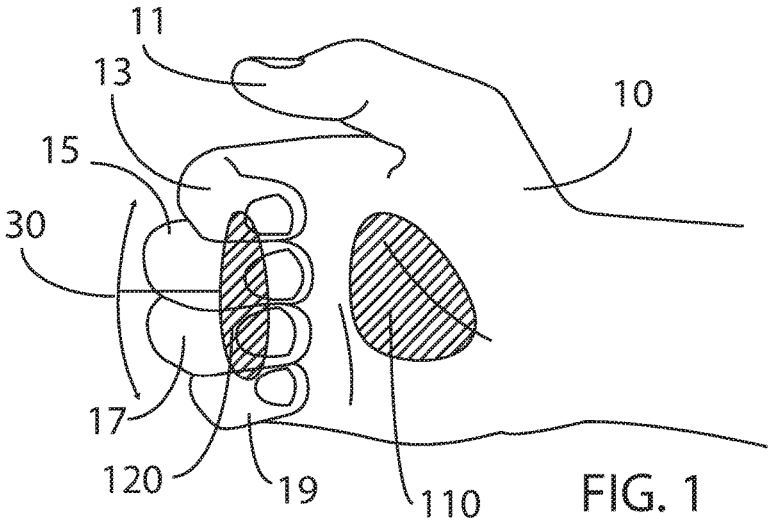
FIG. 1 is a side elevation of a hand with two modular grip enhancement inserts.
Figure 2:
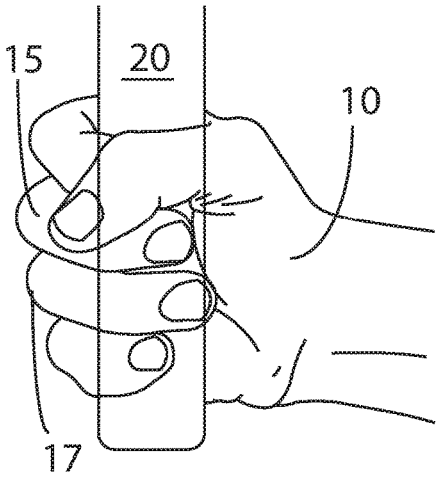
FIG. 2 is a front elevation of a hand with no support (Prior art).
Figure 3:
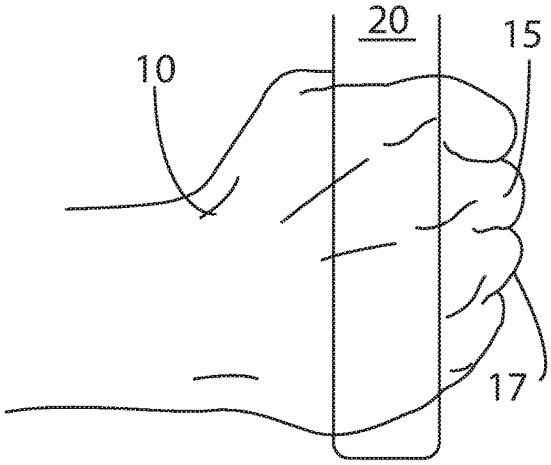
FIG. 3 is a rear elevation of the hand of FIG. 2 (Prior art).

With reference to FIG. 1, the human hand 10 has two voids when forced around a cylindrical or conical grip. These two voids are approximated by grip inserts 110, 120. Grip insert 110 is intended to fill a cavity in the palm of the hand while insert 120 is located proximate the middle 115 and ring 117 fingers. Ideally, the second insert 120 will help the fingers maintain a natural arc 30 for a more relaxed grip experience. Without the inserts (FIGS. 2 and 3), the hand 10 may grasp a handle 20, but the lack of support causes overcompensation in the index finger 113 and thumb 110 and by the pinky 119. The hand 10 essentially collapses on the grip 20. The overcompensation then may lead to repetitive stress injuries, such as tendonitis in the forearm and elbow.

Figure 4:
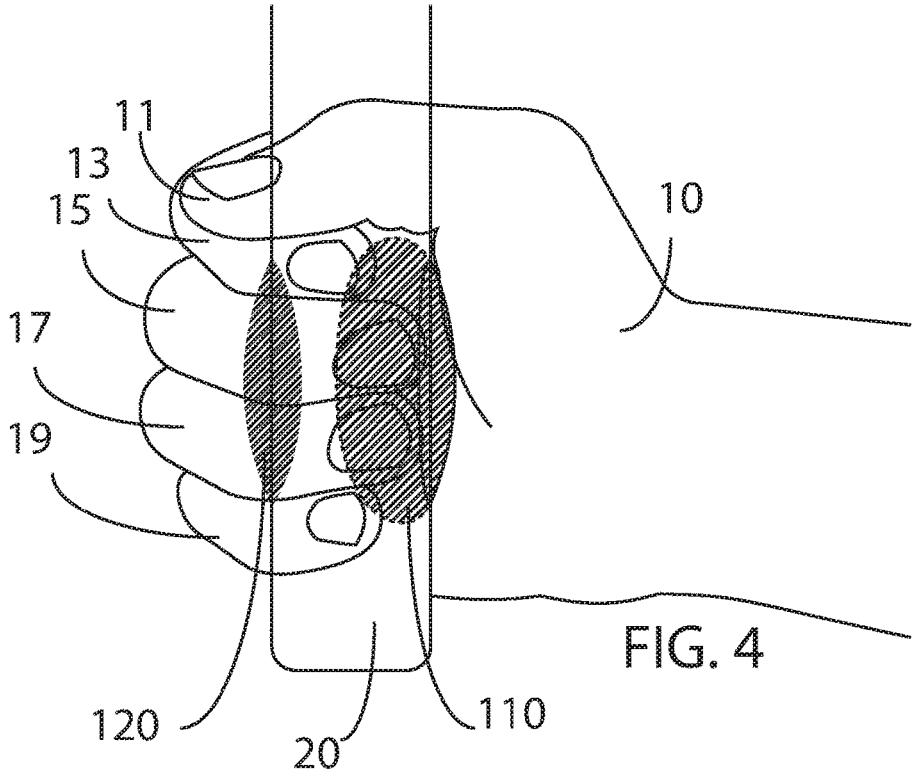
FIG. 4 is a front elevation of a hand with support.
Figure 5:
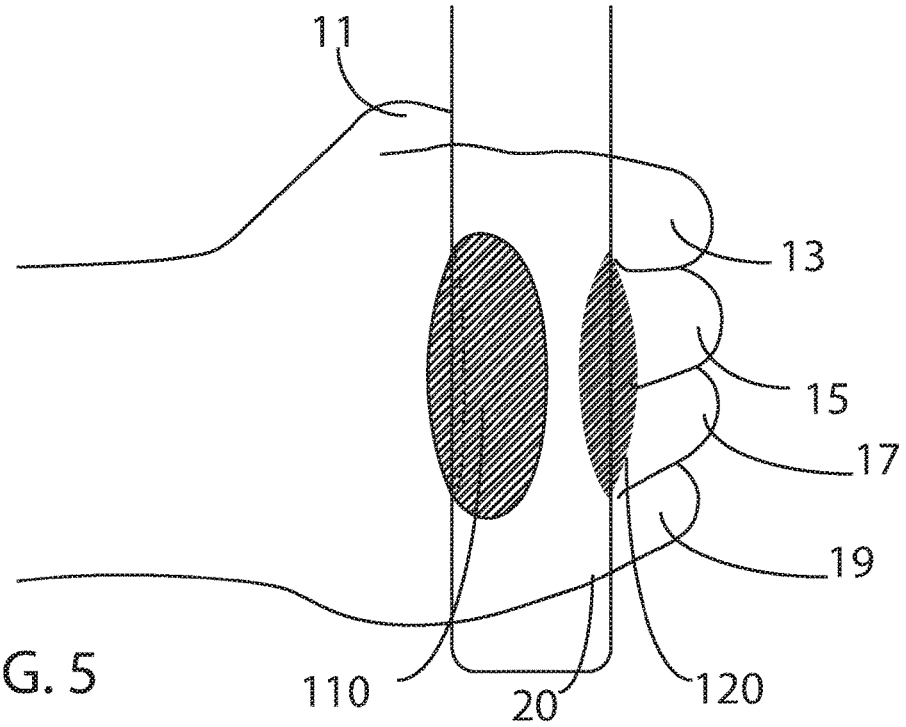
FIG. 5 is a rear elevation of the hand of FIG. 4.

Use of the modular grip enhancement inserts (FIGS. 4 and 5) provide multiaxial, multi-point support to the hand by filling the cavities in the palm and by the fingers. Use of the first insert 110 compensates for the over gripping caused by the thumb 111 and index finger 113 while the second insert allows a natural contoured contact for the middle 115 and ring 117 fingers. This natural contoured contact allows these fingers to adequately grip the handle 20 and distribute the force necessary to control the tool along all five fingers. The contoured contact also registers the tool handle 20 with the hand 10 such that the tool will always be in the same position relative the hand 10. This then provides consistency in the use of the tool, which can be of great importance when the tool is some form of sports equipment or some other tool where such consistency is desirable.

Figure 6:
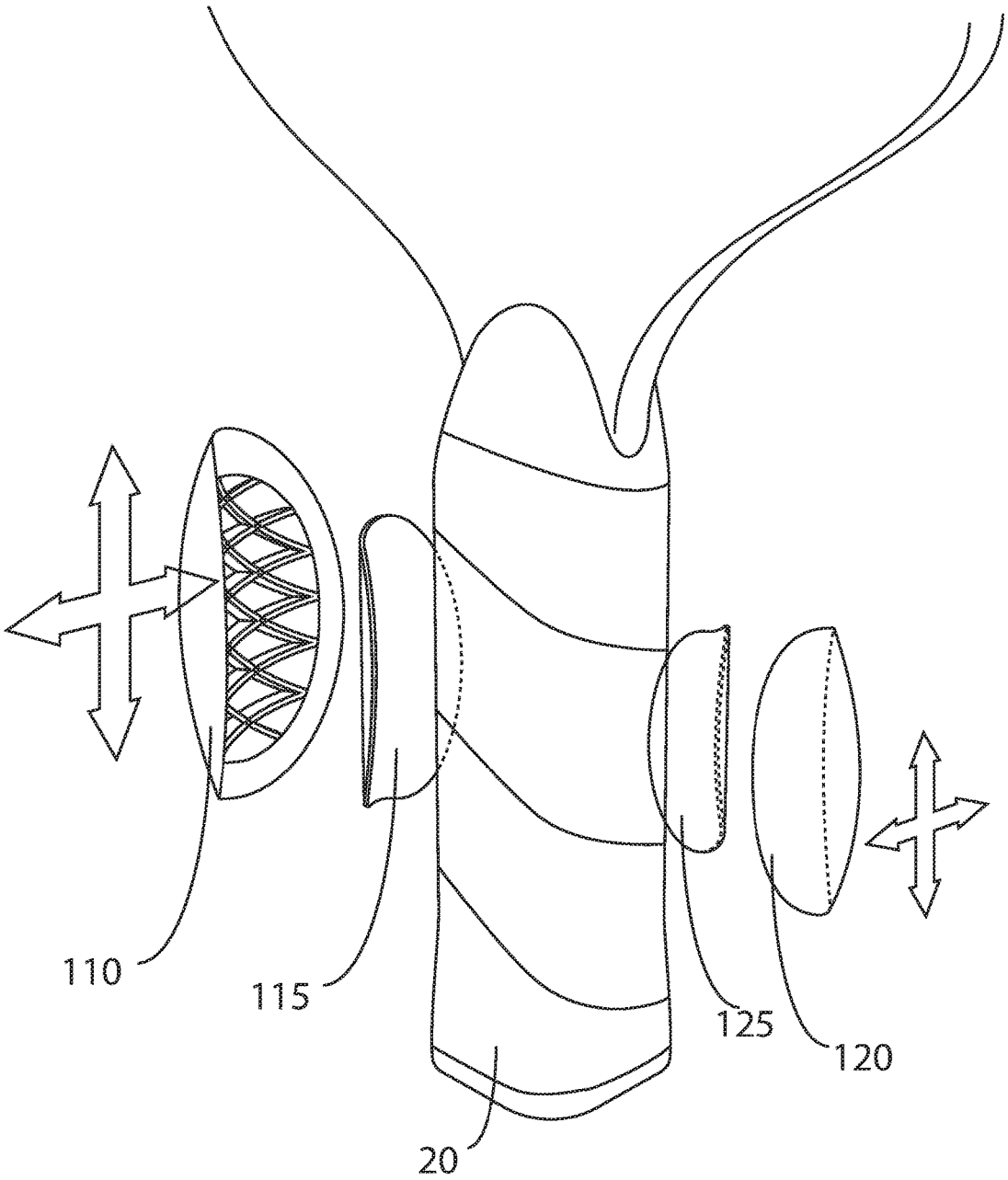
FIG. 6 is a perspective view of a racket with alternate modular grip enhancement inserts.

In use (FIG. 6), at least two inserts 110, 120 are provided, one for the palm cavity and one for the finger cavity, which are generally opposite each other. Providing a set of inserts with at least two different sizes and or shapes for each insert allows for them to be tried out for optimum performance and relocated or exchanged if needed. In the preferred embodiment, at least one additional set of alternate inserts, 115, 125, should also be provided to compensate for different hand 10 and handle 20 sizes and geometries. Two, or possibly more, differently-sized inserts can be used to account for different palm and finger sizes and relative distances, and also accommodate different tool handles. Multiple inserts of the same shape and size may also be provided in such a set, as two identical inserts could also be used as the first and second inserts (note that inserts 115 and 120 are approximately the same size). Inserts 110, 120 should be applied to the grip/handle 20 by a temporary adhesive and the tool used to determine proper fit. Inserts 110, 120 may then be moved or switched with alternate inserts 115, 125 as needed. Once proper fit is established, the inserts may then be made a permanent part of the handle 20, such as permanent adhesives, grip tape, or other securement methods. A single piece with two bulbous bodies would have less adaptability and customization, though could still function as a less ideal module.

Figure 7:
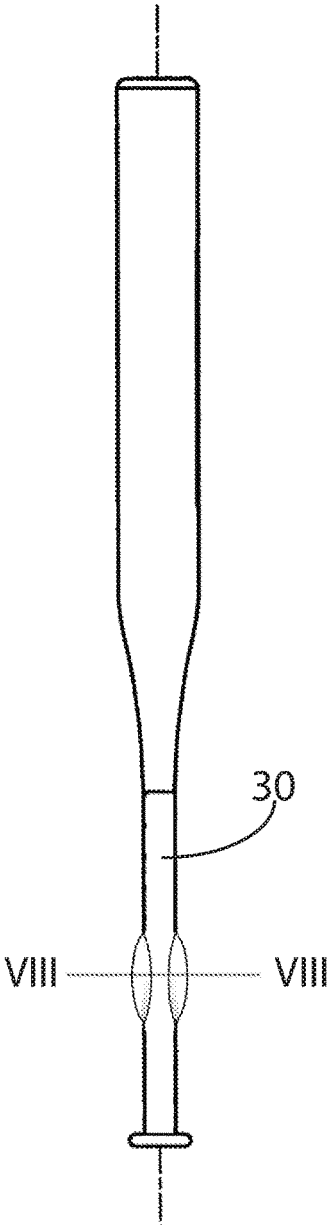
FIG. 7 is a side elevation of a baseball bat utilizing the invention.
Figure 8:
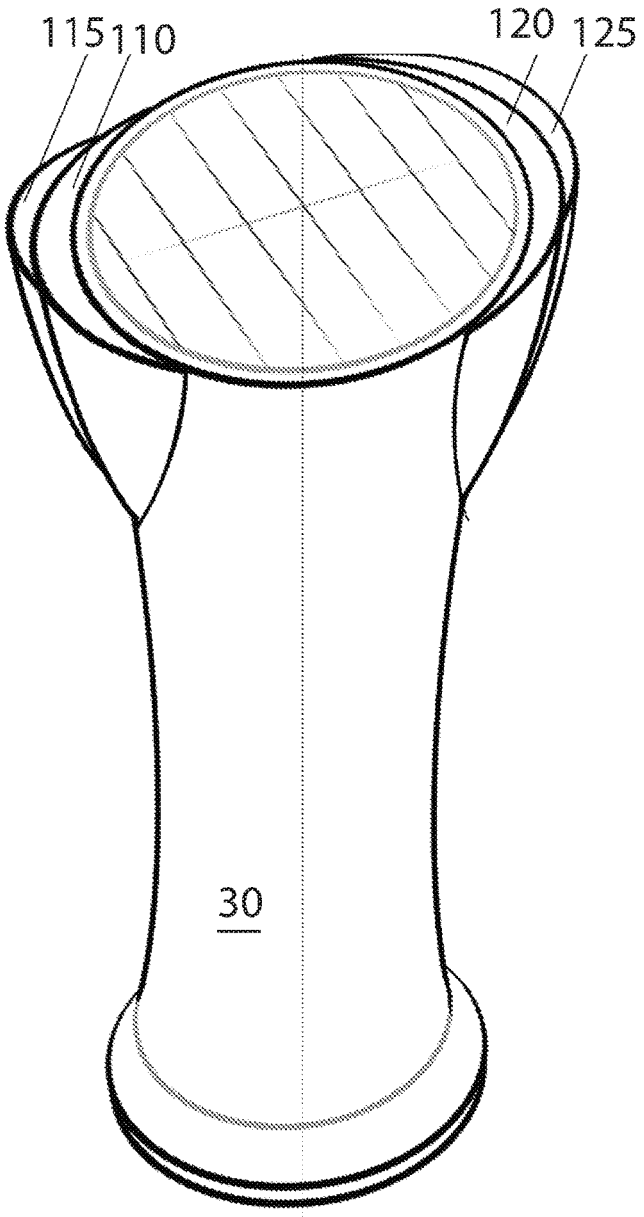
FIG. 8 is a cross-section of the baseball bat of FIG. 7, taken along line VIII-VIII.
Figures 9A, 9B, 9C:
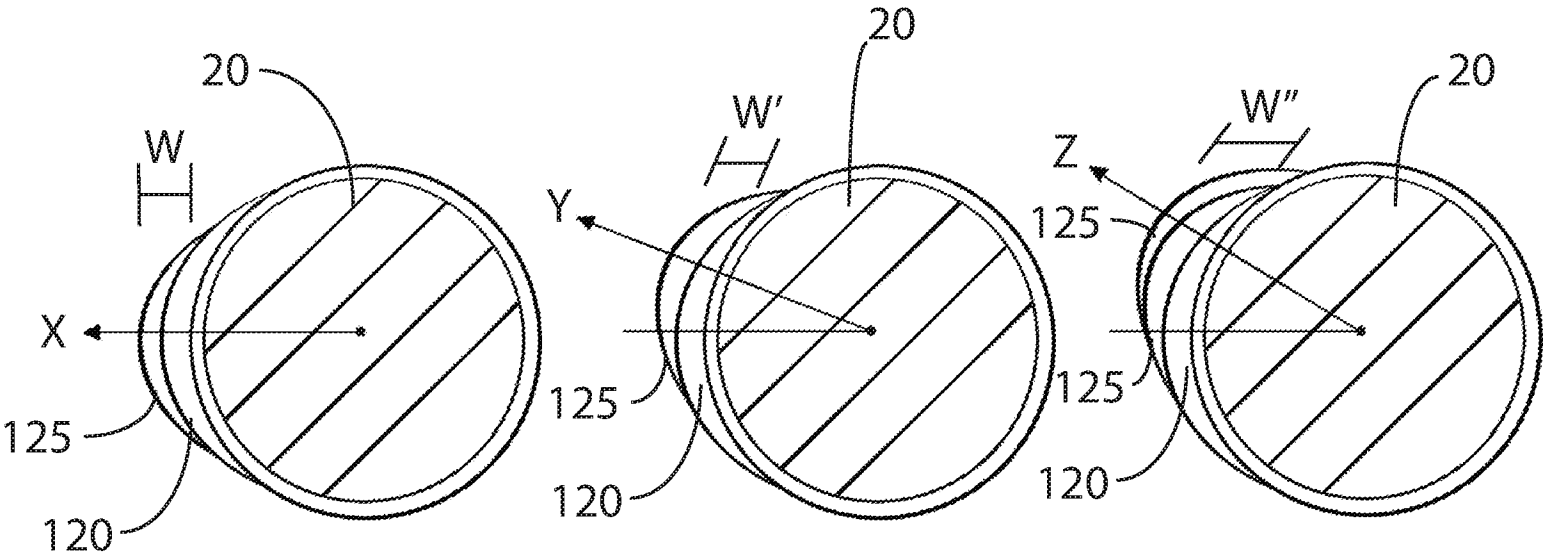
FIGS. 9A-9C are sectional views of a handle with three grip enhancement insets positioned at various angles to create an axially modifiable grip.

Of particular note is the ability of the inserts to create multi-axial grip possibilities. It should be noted in FIGS. 7 and 8 that each insert (110, 115, 120, 125) is shaped similarly to a meniscus lens, featuring a concave inner surface which nests with the convex outer surface of either the handle 30 or other inserts. The meniscus shape can be generally described as a positive meniscus, having a thicker middle than the edges, though there may be occasions where a negative meniscus shape would be beneficial. For the preferred embodiment, the convex outer surface has a greater curvature than the concave inner surface. This feature, combined with the inherent flexibility of the inserts themselves, allows the inserts to nest on each other. Each insert may be angled in a fashion to offset a natural major or minor axis of the handle 30. This is shown in further detail in FIGS. 9A-9C. As can be seen in these figures, a round handle 20 has two inserts 120, 125 stacked on its circumference, defining an axis X where the insert's (or inserts' as shown in FIG. 9) combined maximum width W resides on the handle. Alternately, a second axis Y could also be defined, providing initial support as with the first X axis but diverting the axis as a whole. This axis Y would also be defined by the point of maximum width W' of the two inserts combined, but this would be offset as the second insert is likewise offset from the first. Still further, a third axis Z may be defined by adding yet another insert 125 over the existing two and creating another point of maximum width W". In this manner, an infinite series of axis may be defined and utilized by a user. While this is not well seen with a round example, there may be non-symmetrical features on the tool, club, paddle, etc. which would make the definition of such an axis advantageous. These axes may either enhance or reduce the natural axes of non-round handles.

Inserts may be made of any suitable material, with molded polymers being preferred. Polymer durometer may be selected to provide a balance of cushioning and support. An inter-webbed understructure may be provided to reduce weight while maintaining physical integrity. Shapes of each insert may be varied for the type of grip (straight or conical) and for various hand shapes. Multiple inserts may be designed to co-operatively fill one void. Inserts may be identical to each other, or not.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. A grip enhancement system for a tool grip having a circumference, the grip enhancement system comprising a plurality of meniscus-shaped inserts of at least two different sizes, a first of the plurality of meniscus-shaped inserts positioned on the circumference of the tool grip and a second of the plurality of meniscus shaped inserts positioned on the first meniscus-shaped insert, the first meniscus-shaped insert defining an axis at its thickest point and the second meniscus shaped insert creating a second, different, axis at a thickest point of the first and second meniscus-shaped inserts combined.

2. The grip enhancement system of claim 1, further comprising a third of the plurality of meniscus shaped inserts being positioned upon the tool grip.

3. The grip enhancement system of claim 2, further comprising a fourth of the plurality of meniscus-shaped inserts being positioned on the third meniscus-shaped insert.

4. A grip enhancement system for a tool grip having a circumference, the grip enhancement system comprising a plurality of meniscus-shaped inserts of at least two different sizes, a first of the plurality of meniscus-shaped inserts positioned on the circumference of the tool grip, defining an axis at its thickest point, and a second of the plurality of meniscus shaped inserts positioned on the first meniscus-shaped insert such that the second of the plurality of meniscus-shaped inserts does not entirely cover the first of the plurality of meniscus-shaped inserts and thereby creating a second, different axis at the thickest point of the first and second meniscus-shaped inserts combined.

5. The grip enhancement system of claim 4, further comprising a third of the plurality of meniscus shaped inserts being positioned upon the tool grip.

6. The grip enhancement system of claim 5, further comprising a fourth of the plurality of meniscus-shaped inserts being positioned on the third meniscus-shaped insert.

* * * * *